US007429969B2

(12) United States Patent
Chang

(10) Patent No.: US 7,429,969 B2
(45) Date of Patent: Sep. 30, 2008

(54) METHOD FOR DRIVING A CURRENT-DRIVEN ACTIVE MATRIX ORGANIC LIGHT EMITTING DIODE PIXEL

(75) Inventor: Yi-Chen Chang, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 348 days.

(21) Appl. No.: 10/604,818

(22) Filed: Aug. 19, 2003

(65) Prior Publication Data

US 2004/0257314 A1 Dec. 23, 2004

(30) Foreign Application Priority Data

Jun. 20, 2003 (TW) ..... 92116779 A

(51) Int. Cl.
*G09G 3/32* (2006.01)

(52) U.S. Cl. ..... 345/82; 315/169.3; 340/815.45; 345/76

(58) Field of Classification Search ..... 315/169.3; 345/82, 84, 91–92, 98; 340/815.45
See application file for complete search history.

(56) References Cited

U.S. PATENT DOCUMENTS

| | | | | |
|---|---|---|---|---|
| 6,229,508 | B1 * | 5/2001 | Kane | 345/82 |
| 6,756,741 | B2 * | 6/2004 | Li | 315/169.3 |
| 6,859,193 | B1 * | 2/2005 | Yumoto | 345/82 |
| 6,924,602 | B2 * | 8/2005 | Komiya | 315/169.3 |
| 2003/0030382 | A1 * | 2/2003 | Koyama | 315/169.1 |

* cited by examiner

*Primary Examiner*—Amr Awad
*Assistant Examiner*—Michael Pervan
(74) *Attorney, Agent, or Firm*—Jinaq Chyun IP Office

(57) ABSTRACT

A method for driving a current-driven Active Matrix Organic Light Emitting Diode (AMOLED) pixel, which provides a pre-charging signal (Pre-Charge) to drive the current source before the data of the AMOLED is updated. The capacitor is thereby discharged via the discharging path to avoid the incorrect display picture problem due to an insufficient discharge when the display frame is being changed.

2 Claims, 2 Drawing Sheets

METHOD FOR DRIVING A CURRENT-DRIVEN ACTIVE MATRIX ORGANIC LIGHT EMITTING DIODE PIXEL

CROSS REFERENCE TO RELATED APPLICATIONS

This application claims the priority benefit of Taiwan application serial no. 92116779, filed on Jun. 20, 2003.

BACKGROUND OF INVENTION

1. Field of the Invention

The present invention relates to an Active Matrix Organic Light Emitting Diode (AMOLED) pixel, and more particularly, to a method for driving a current-driven AMOLED pixel.

2. Description of the Related Art

Accompanying with the progress of the information technology, more advance models for the variety of information devices, such as computer, mobile phone, and personal digital assistant (PDA), are continuously being developed. The display always plays a significant role in these information devices. Specifically, the flat panel displays are gradually becoming more popular since it provides the advantages of being thinner, lighter, and power saving.

Among the various flat panel displays, the Active Matrix Organic Light Emitting Diode (AMOLED) display comprises the advantages of wider view angle, better color contrast, lighter and thinner, faster response and lower cost. The Active Matrix Organic Light Emitting Diode (AMOLED) display is thus quite suitably applied in, for example, electronic clocks, mobile phones, PDAs, and digital cameras.

Referring to FIG. 1, FIG. 1 is a schematic view of a voltage-driven AMOLED pixel. As shown in the drawing, the AMOLED pixel comprises a switching TFT (Thin Film Transistor) 110, a driving TFT 120, a capacitor 130, and an Organic Light Emitting Diode (OLED) 140. The display gray level is determined by the voltage on the data line. When the scanning line is scanning the pixel, the switching TFT 110 is turned on to transmit the voltage on the data line to the gate of the driving TFT 120, so as to obtain a gate voltage Vg which is used to drive the required current to flow through the OLED 140 for displaying. The current Id flowing through the OLED 140 is generally expressed by following equation:

$$Id=(1/2)k(Vgs-Vth)(Vgs-Vth) \quad (1)$$

However, since the threshold voltage Vth and the mobility of the driving TFT 120 for different pixels are different due to its uneven manufacturing processes, the current Id flowing through the OLED 140 is not the same under the condition of the same gray level voltage. Thus, the problem of an uneven display picture occurs.

Therefore, a current-driven AMOLED pixel is developed. Referring to FIG. 2, it is a schematic view of a conventional current-driven AMOLED pixel. As shown in the drawing, the AMOLED pixel comprises a first TFT 210, a second TFT 220, a third TFT 230, a capacitor 240, a driving TFT 250, and an OLED 260. When it is operating, at first, a scanning control signal of the scanning line is used to turn on the first TFT 210 and the second TFT 220, such that the current provided by the current source flows through the second TFT 220 to charge the capacitor 240. Meanwhile, the memorized gate voltage makes the current flowing through the first TFT 210 and the third TFT 230 are equal to the current of the current source. Then, when the scanning control signal of the scanning line is cut off (SCAN OFF), the gate voltage previously memorized is used to control the driving TFT 250, such that the current flowing through the OLED 260 is equal to the current of the current source so as to display the required brightness.

However, when this current-driven AMOLED pixel is used to display contiguous frames having a great variance in its display gray level, the incorrect picture display problem due to an insufficient discharge of the gate voltage memorized on the capacitor 240 may occur. For example, assuming that the required current of the current source for the $n^{th}$ frame is 20 μA, a voltage Vn is thereby stored on the capacitor 240. However, the required current of the current source for the $n+1^{th}$ frame is only 1 μA; thus, the voltage stored on the capacitor 240 has to discharge to Vn+1 within a very short period. The insufficient discharge problem thereby occurs.

SUMMARY OF INVENTION

It is an object of the present invention to provide a method for driving a current-driven AMOLED pixel. The method provides a pre-charging signal to the driving current source before the data of the AMOLED pixel is updated in order to have the capacitor discharge via a discharging path; thus avoiding the insufficient discharge problem.

In order to achieve the object mentioned above and others, the present invention provides a method for driving a current-driven AMOLED pixel. The method comprises the steps of: updating a current value of a current source for driving an AMOLED pixel; turning on a charging path used by the current source to charge a capacitor of the AMOLED pixel; in the initial stage of the turning on of the charging path used by the current source to charge the capacitor of the AMOLED pixel, providing a pre-charging signal to the current source to discharge the capacitor; and completing the charging of the capacitor and cutting off the charging path used by the current source to charge the capacitor of the AMOLED pixel.

Further, the providing of the pre-charging signal may be set to have the capacitor discharge to a pre-determined potential value.

It is known from the description above that by applying the method for driving the current-driven AMOLED pixel provided by the present invention, a pre-charging signal is provided to the driving current source before the data of the AMOLED pixel is updated to have the capacitor discharge via a discharging path to avoid the insufficient discharge problem.

BRIEF DESCRIPTION OF DRAWINGS

The accompanying drawings are included to provide a further understanding of the invention, and are incorporated in and constitute a part of this specification. The drawings illustrate embodiments of the invention, and together with the description, serve to explain the principles of the invention.

DETAILED DESCRIPTION

Figure 1:
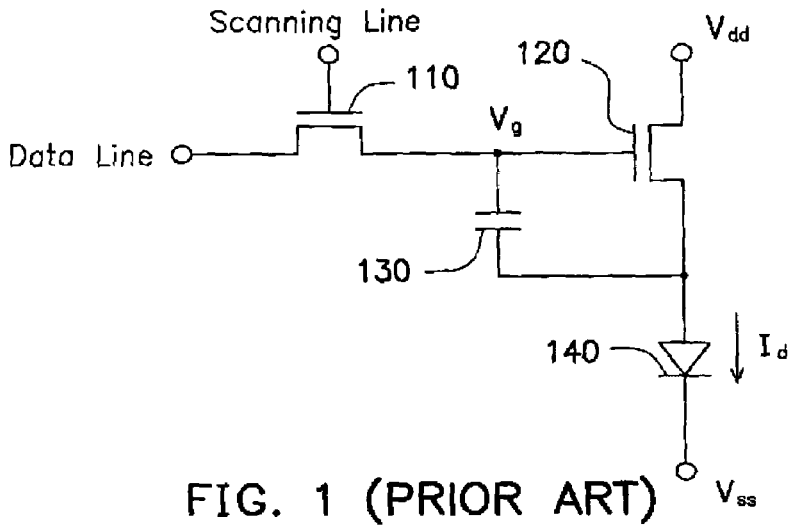
FIG. 1 (PRIOR ART)
FIG. 1 is a schematic view of a voltage-driven AMOLED pixel.
Figure 2:
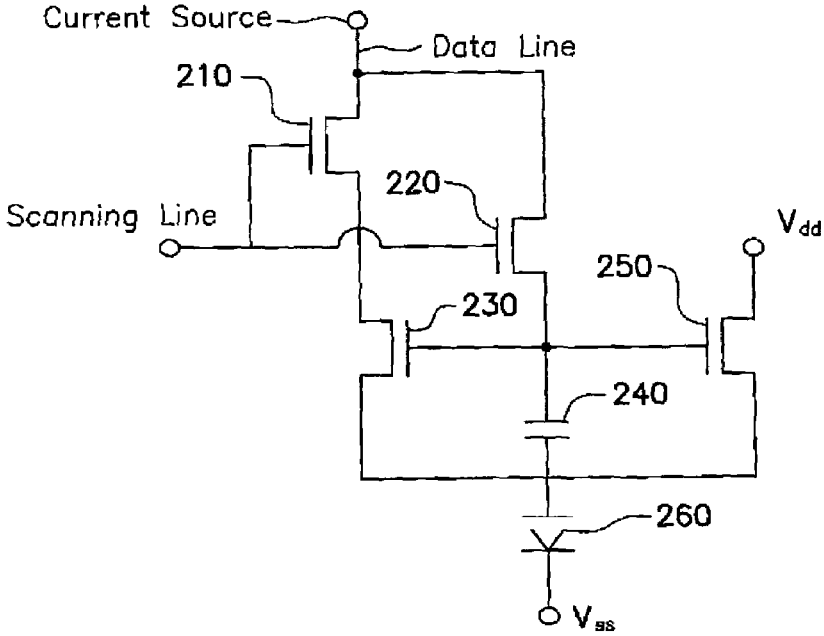
FIG. 2 (PRIOR ART)
FIG. 2 is a schematic view of a current-driven AMOLED pixel.
Figure 3:
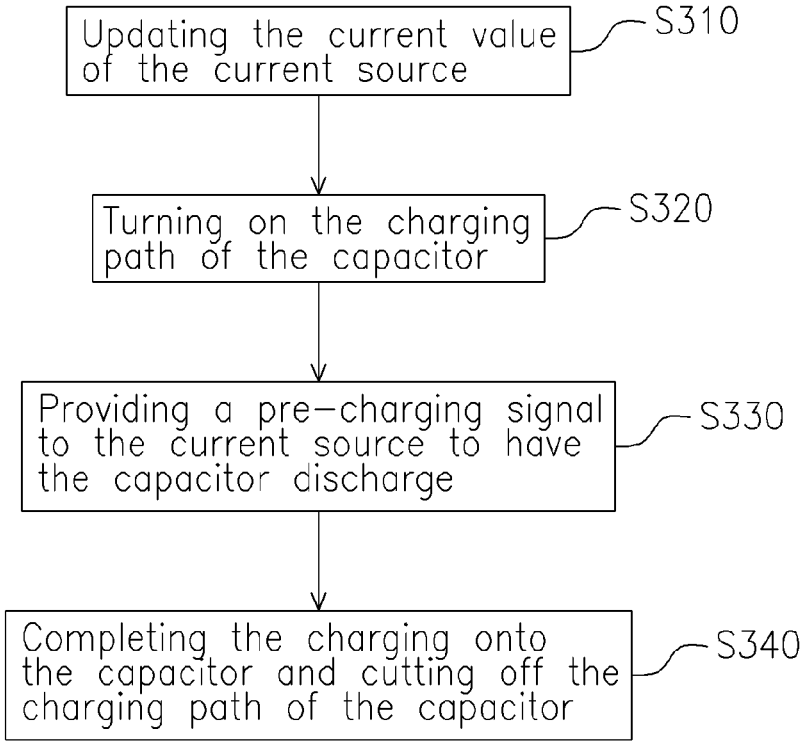
FIG. 3 is a flow chart illustrating a method for driving the current-driven AMOLED pixel of a preferred embodiment according to the present invention.

Referring to FIG. 3, FIG. 3 is a flow chart illustrating a method for driving the current-driven AMOLED pixel of a preferred embodiment according to the present invention. As described above, in order to avoid the incorrect picture display problem due to the insufficient discharge of the memorized gate voltage when the current-driven AMOLED pixel is displaying the contiguous frames having a great variance in its display gray level, a pre-charging signal is provided to the current source in step S330 of the flow chart for discharging the capacitor in advance. Further, the processes of the method are further described in reference to the circuit shown in FIG. 2 hereinafter.

As shown in FIG. 2, since the display gray level of the current-driven AMOLED pixel is expressed by the current magnitude of the current source, when a picture is being displaced, the current value of the current source of the AMOLED pixel (S310) needs to be updated in order to update the display data value of the AMOLED pixel.

Thereafter, the first TFT 210 and the second TFT 220 are turned on by the scanning control signal of the scanning line. In other words, the charging path of the capacitor 240 is turned on (S320). Meanwhile, the control system further provides a pre-charging signal (Pre-Charge) to the current source to have the capacitor discharge in advance (S330). Preferably, this step is set to have the capacitor 240 discharge to a predetermined potential value to facilitate the subsequent charging operation.

Figure 4:
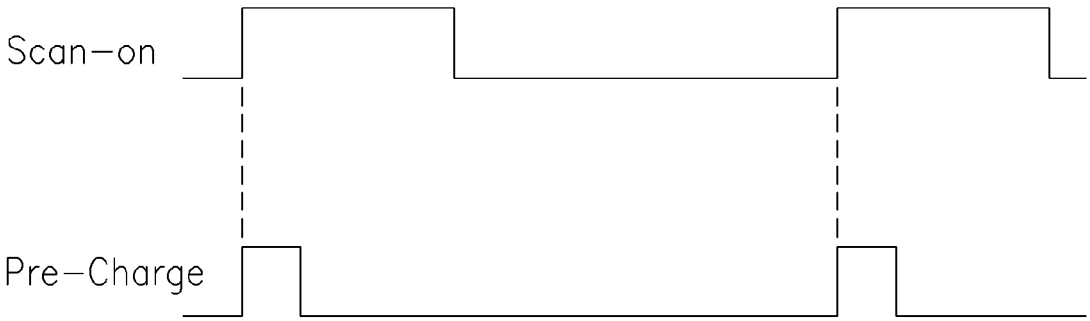
FIG. 4 is a schematic timing diagram of the scanning control signal and the pre-charging signal.

Afterwards, the current provided by the current source is controlled to flow through the second TFT 220 and to charge the capacitor 240. The memorized gate voltage thus causes the current flowing through the first TFT 210 and the third TFT 230 to be equal to the current of the current source, and cuts off the scanning control signal of the scanning line (SCAN OFF). In other words, the first TFT 210 and the second TFT 220 are turned off to cut off the charging path of the capacitor 240 (S340). Moreover, the gate voltage memorized previously is used to control the driving TFT 250, such that the current flowing through the OLED 260 is equal to the current of the current source for displaying the required brightness. The operating timing related to the scanning control signal (Scan-On) and the pre-charging signal (Pre-Charge) is as shown in the timing diagram of FIG. 4.

The present invention provides a pre-charging signal (Pre-Charge) to the driving current source before the data of the AMOLED pixel is updated to have the capacitor 240 discharge via a discharging path in advance, so as to avoid the insufficient discharge problem.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

The invention claimed is:

1. A method for driving a current-driven Active Matrix Organic Light Emitting Diode (AMOLED) pixel, comprising:

updating a current value of a current source of the AMOLED pixel;

turning on a charging path used by the current source to charge a storage capacitor of the AMOLED pixel;

in an initial stage of the turning on of the charging path used by the current source to charge the storage capacitor of the AMOLED pixel, in response to a scanning control providing a pre-charging signal, higher than zero voltage, to the current source to have the storage capacitor discharged in advance;

wherein the pre-charging signal makes the storage capacitor to discharge to a pre-determined potential value; and completing the charging of the storage capacitor, and cutting off the charging path used by the current source to charge the storage capacitor of the AMOLED pixel.

2. A method for driving a current-driven Active Matrix Organic Light Emitting Diode (AMOLED) pixel, the AMOLED pixel comprising a first through a fourth transistors, a storage capacitor and an OLED, wherein gates of fine first and second transistors are coupled to a scanning line, drains of the first and second transistors are coupled to a current source, a source of the first transistor is coupled to a drain of the third transistor, a source of the second transistor is coupled to gates of the third and fourth transistors and one end of the storage capacitor, sources of the third and fourth transistors are coupled to the other end of the storage capacitor and an anode of the OLED, a drain of the fourth transistor is coupled to a power source, and a cathode of the OLED is coupled to a reference voltage, the method comprising:

updating a current value of the current source of the AMOLED pixel;

turning on a charging path used by the current source to charge the storage capacitor of the AMOLED pixel;

in an initial stage of the turning on of the charging path used by the current source to charge the storage capacitor of the AMOLED pixel, in response to a scanning control signal, providing a pre-charging signal, higher than zero voltage, to the current source to have the storage capacitor discharged in advance;

wherein the pre-charging signal makes the storage capacitor to discharge to a pre-determined potential value; and completing the charging of the storage capacitor, and cutting off the charging path used by the current source to charge the storage capacitor of the AMOLED pixel.

* * * * *